US006131339A

United States Patent [19]

Ramus

[11] Patent Number: 6,131,339

[45] **Date of Patent: *Oct. 17, 2000**

[54] WINDOW ASSEMBLY AND MOUNT FOR A WINDOW ASSEMBLY

[75] Inventor: Kevin J. Ramus, Troy, Mich.

[73] Assignee: PPG Industries Ohio, Inc., Cleveland, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/209,111

[22] Filed: Dec. 10, 1998

[51] Int. Cl.[7] ..... E05F 11/38

[52] U.S. Cl. ..... 49/375

[58] Field of Search ..... 49/375, 374, 348, 49/349, 350, 351

[56] References Cited

U.S. PATENT DOCUMENTS 4,776,132 10/1988 Gold .
4,835,908 6/1989 Londeck et al. .
4,943,179 7/1990 Horiki et al. .
5,050,348 9/1991 Kane et al. ..... 49/375 X
5,226,259 7/1993 Yamagata et al. .
5,515,651 5/1996 Hofmann et al. ..... 49/375
5,546,704 8/1996 Maruoka ..... 49/375
5,778,599 7/1998 Saito ..... 49/375

*Primary Examiner*—Jerry Redman
*Attorney, Agent, or Firm*—Donald C. Lepiane

[57] ABSTRACT

The present invention provides a mount assembly for a vehicle window, comprising a bracket having a section with first and second opposing major surfaces, a receiver having first and second spaced apart leg members positioned such that when the section of the bracket is positioned between the first and second leg members, at least a portion of the first leg member contacts the first major surface of the bracket and a portion of the second leg member contacts the second major surface of the bracket to provide a clamping force against the section of the bracket, and an interlocking assembly to interlock the fastener and bracket when the section of the bracket is positioned between the leg members.

20 Claims, 3 Drawing Sheets

WINDOW ASSEMBLY AND MOUNT FOR A WINDOW ASSEMBLY

BACKGROUND OF THE INVENTION

1. Field of the Invention

This invention relates to connecting a reciprocating vehicle window to a regulator and in particular to a connecting arrangement that does not require mounting or connecting holes that extend through the window and provides for easy connection between the window and regulator.

2. Technical Considerations and Prior Art

Automotive windows are often provided with edge attachments or other various types of members along selected edges of the window to connect the window to a reciprocating mechanism, or regulator, so that the window can move vertically in the vehicle within a window opening channel, e.g. as disclosed in U.S. Pat. Nos. 4,776,132 to Gold; 4,835,908 to Londeck et al.; 4,943,179 to Horiki et al. and 5,226,259 to Yamagata et al. These arrangements generally include unitary mounting brackets or frames that are secured to an edge of the window by adhesive or bolts extending through the window. The mounting brackets are secured directly to the window regulator. In U.S. Pat. No. 5,515,651 to Hofmann, et al., the window is positioned between a pair of retaining legs of a fastening device which captures a connecting member positioned on or through the window surface. It is important that the connection hardware be secured to the window at the correct location so that it is properly aligned with the window regulator and the window assembly is properly aligned within the vehicle into which it is installed. In the instance when the window assembly is replaced, these arrangements require that the brackets be unbolted from the window regulator in order to remove the window assembly. It would be advantageous to provide a window mounting arrangement which makes it easier to disengage the window from the regulator and remove the window from the vehicle door, as well as provide an easier way to reconnect the window to the regulator.

SUMMARY OF THE INVENTION

The present invention provides a mount assembly for a vehicle window, comprising a bracket having a section with first and second opposing major surfaces, a receiver having first and second spaced apart leg members positioned such that when the section of the bracket is positioned between the first and second leg members, at least a portion of the first leg member contacts the first major surface of the bracket and a portion of the second leg member contacts the second major surface of the bracket to provide a clamping force against the section of the bracket, and an interlocking assembly to interlock the receiver and bracket when the section of the bracket is positioned between the leg members.

The present invention also provides a window assembly comprising a window, a regulator, a bracket having at least one leg member secured to a portion of a major surface of the window and a section extending from the leg member, the section having first and second opposing major surfaces, a receiver secured to the regulator and having first and second spaced apart leg members, wherein the section of the bracket is positioned between the first and second leg members of the receiver such that at least a portion of the first leg member of the receiver contacts the first major surface of the section of the bracket and a portion of the second leg member of the receiver contacts the second major surface of the section of the bracket to provide a clamping force against the section of the bracket, and an interlocking assembly to interlock the receiver and bracket and interconnect the window and regulator.

The present invention further provides a window assembly comprising a window, a regulator, a bracket secured to said regulator and having a section with first and second opposing major surfaces extending from said leg member, a receiver secured to a portion of a major surface of said window and having first and second spaced apart leg members forming a slot, wherein said section of said bracket is positioned within said slot of said receiver such that at least a portion of said first leg member of said receiver contacts said first major surface of said section of said bracket and a portion of said second leg member of said receiver contacts said second major surface of said section of said bracket to provide a clamping force against said section of said bracket, and an interlocking assembly to interlock said receiver and bracket and interconnect said window and regulator.

DETAILED DESCRIPTION OF THE INVENTION

Figure 1:
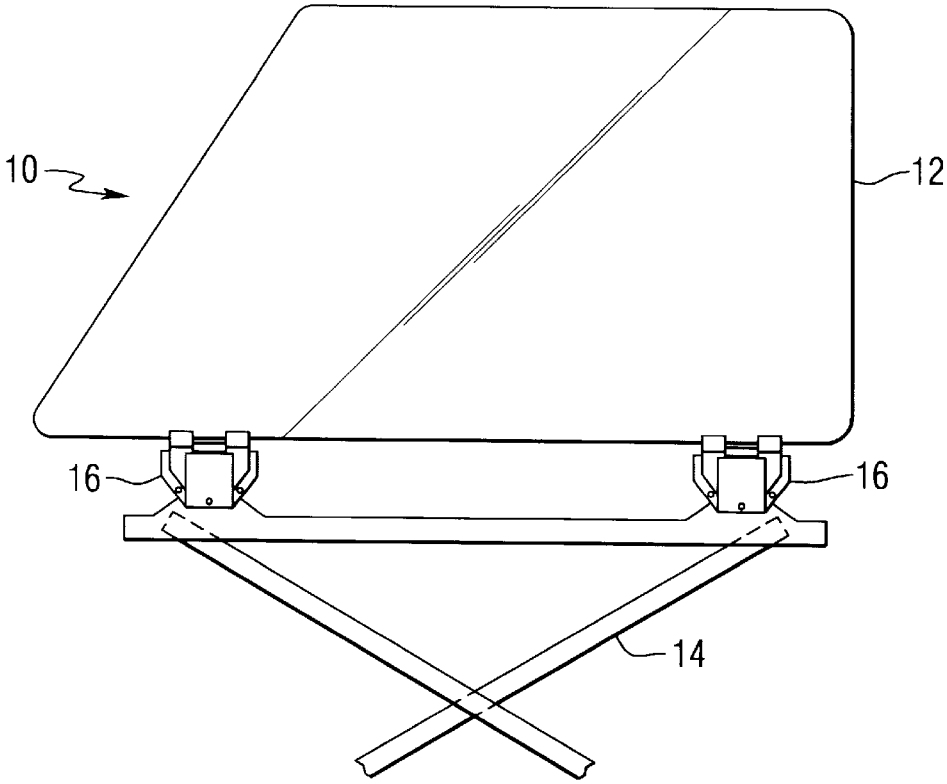
FIG. 1 is a plan view of a window assembly incorporating features of the present invention.

FIG. 1 illustrates a window assembly 10 for a motor vehicle which includes a window 12 that is shaped in any convenient fashion to a desired curvature which generally matches the contours of the vehicle body (not shown) into which the window assembly 10 is installed. Although not required, the window 12 is preferably constructed of glass, polycarbonate and/or other transparent materials. In addition, the window 12 may be a laminate incorporating one or more of these materials. Window 12 is connected to a window reciprocating device 14, e.g. a window regulator of a type well known by those skilled in the art, by at least one mount assembly 16, which is an object of the instant invention. Mount assembly 16 includes interlocking elements that eliminate the need for drilling holes through the window 12 in order to secure window 12 to regulator 14 and also provides easy connection and disconnection of the regulator 14 from the window 12. As used herein, "interlock" and "interlocking" means that selected elements of the mount assembly 16 become engaged or interrelated with each other such that it is difficult to separate the elements. More specifically, mount assembly 16 includes a bracket 18, which is secured to window 12, and a receiver 20, which is secured to regulator 14 (shown only in FIG. 1).

Figure 4:
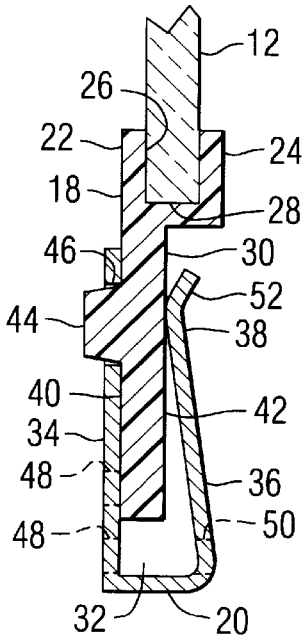
FIG. 4 is a view taken along line 4—4 of FIG. 2, with portions removed for clarity.
Figure 2:
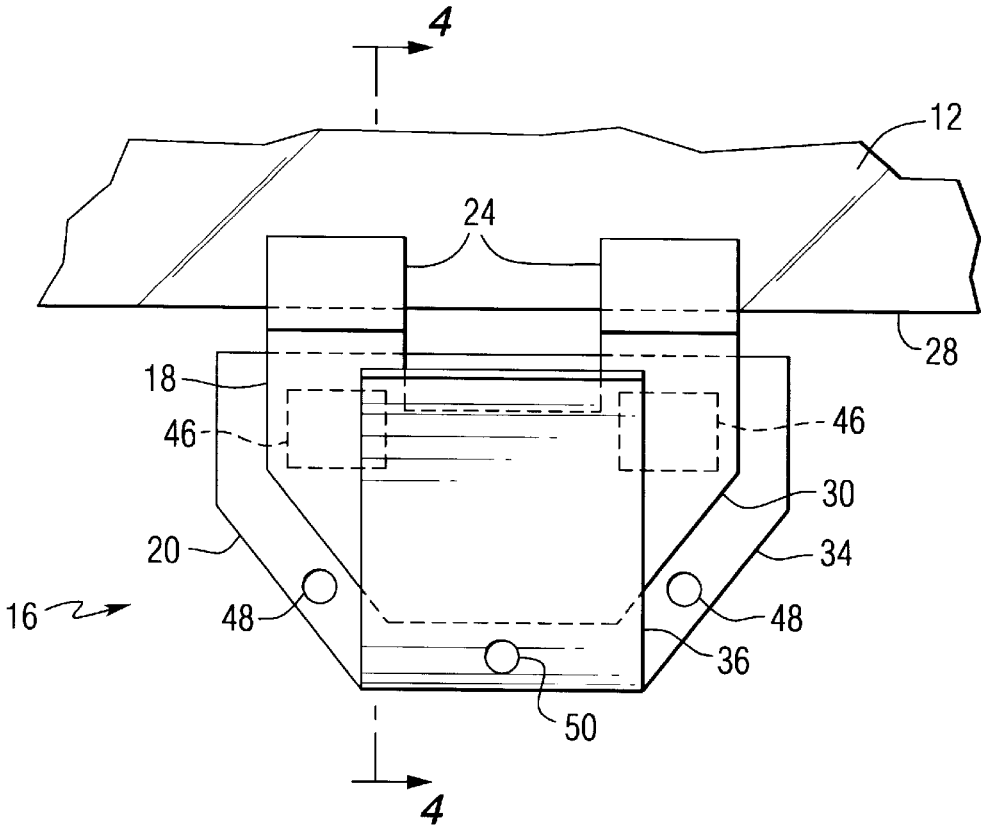
FIG. 2 is an enlarged plan view of a mount assembly illustrated in FIG. 1, with portions removed for clarity.
Figure 3:
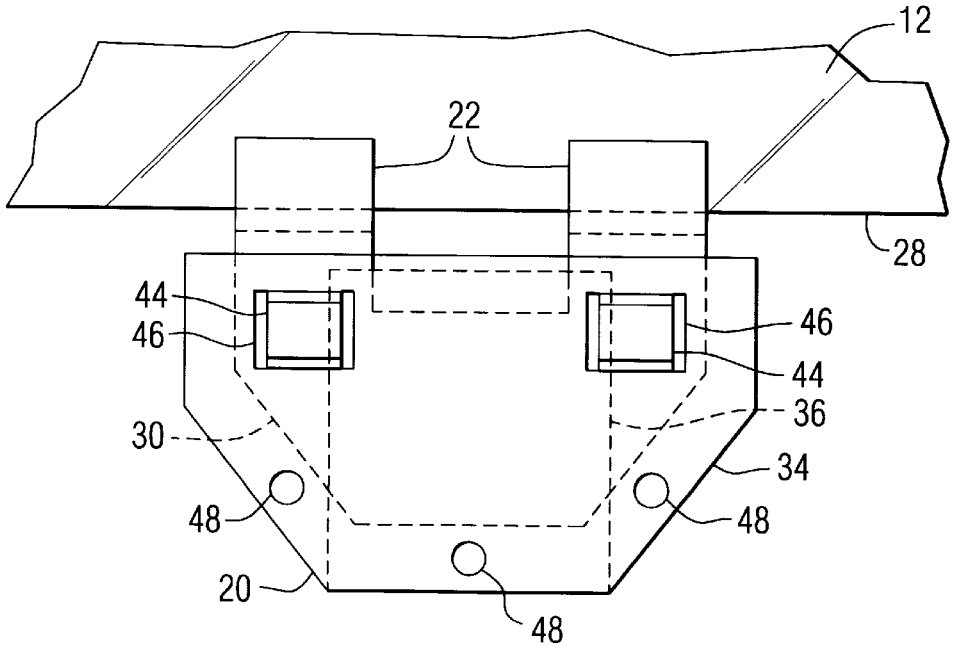
FIG. 3 is a plan view of the opposite side of the mount assembly illustrated in FIG. 2.

Although not limiting in the instant invention, in the embodiment illustrated in FIGS. 2, 3 and 4, bracket 18 includes a pair of leg members 22 and 24 which form a recess 26 to receive window 12. Bracket 18 is secured to window 12 by an adhesive of a type well known in the art, applied within recess 26. In this manner, the need for a hole through the window 12 to attach a mounting assembly is eliminated. As an alternative, bracket 18 may be configured with only a single leg member such that bracket 18 is secured to only one of the opposing major surfaces of window 12 and window edge 28. Receiver 20 is secured to the regulator 14 in any convenient manner known by those skilled in the art, e.g. bolting or riveting as will be discussed later in more detail. Bracket 18 includes a section 30 that extends away from legs 22 and 24 and window 12 and is received within a slotted opening 32 in receiver 20. More specifically and while not limiting in the instant invention, in the particular embodiment illustrated in FIGS. 2–4, receiver 20 includes a pair of members positioned to receive and retain section 30 of bracket 18. In particular, receiver 20 includes a plate 34 which is folded back along itself to form a flange 36. Plate 34 and flange 36 form slot 32. At least a portion 38 of flange 36 is closely spaced to plate 34 a distance less than the thickness of section 30 so that as section 30 is positioned within slot 32, at least a portion of plate 34 contacts at least a portion of major surface 40 of section 30 and at least a portion of flange 36 contacts at least a portion of opposing major surface 42 of section 30, biasing flange 36 away from plate 34. Receiver 20 is preferably made of a resilient material that resists this spreading action such that plate 34 and flange 36 provide a clamping force against opposing major surfaces 40 and 42 of section 30. Mount assembly 16 also includes an interlocking assembly that engages bracket 18 with receiver 20. Although not limiting in the present invention, in the particular embodiment illustrated in FIGS. 2–4, section 30 has at least one protuberance or tab 44 along its surface 40 which extends at least partially through opening 46 in plate 34 when section 30 of bracket 18 is inserted within slot 32 of receiver 20. Openings 46 in plate 34 are generally larger than tabs 44 so as to provide for minor tolerances between the relative positions of bracket 18 and receiver 20 and to allow the window 12 to align itself within the mount assembly 16 as it is positioned within the vehicle window opening. As an alternative to openings 46, plate 34 can include detents or other structure to receive tabs 44. The combination of the clamping force provided by plate 34 and flange 36 with tabs 44 extending within openings 46 serves to interlock bracket 18 to receiver 20 and prevent inadvertent removal of section 30 from slot 32 during downward movement of the window 12 by the regulator 14. Holes 48 in plate 34 allows for mechanical connection of any convenient type, such as but not limited to rivets or bolts, to regulator 14 and hole 50 allows for access through flange 36 to such connector.

It should be noted that in the mount assembly of the instant invention, the window 12 is not subjected to any undue stresses due to the interconnection between the bracket 18 and receiver 20. More specifically, the bracket 18 and receiver 20 are interconnected, at least in part, by receiving a portion of bracket 18 within slot 32 of the receiver 20, and in particular section 30 of bracket 18, rather than inserting the window 12 itself into the slot 32. This arrangement provides several advantages over prior art arrangements. For instance, as discussed earlier, a clamping force is developed in receiver 20 when section 30 is positioned between plate 34 and flange 36. If the window 12 itself were subjected to this clamping force, it would be susceptible to fracture. In addition, unlike the window 12, section 30 can be configured with elements that can interlock with the receiver 20, e.g. tabs 44 as discussed above, and provide a more positive connection to the regulator 14. Also, the mount assembly 10 of the present invention allows for easy disconnection between the window 12 and regulator 14 in the event that the window 12, the regulator 14 or other part of the mount assembly 16 must be replaced. In addition, as noted earlier, the bracket 18 of mount assembly 16 is secured to the window 12 without having to drill any holes through the window 12. This not only does away with the drilling step but also eliminates potential weak spots in the window 12 at the hole site.

Other configurations similar to that disclosed herein can be used to interconnect the window 12 with a regulator 14. For example, referring to FIGS. 5 and 6, mount assembly 116 includes a receiver 120 having a plate 134 and flange 136 formed from plate 134. Together, plate 134 and flange 136 form a slot 132. Receiver 120 is secured to a window 112 in a manner as discussed earlier with respect to bracket 18. Mount assembly 116 further includes a bracket 118 which is secured to a window regulator (not shown in FIGS. 5 or 6) in any convenient manner and includes a section 130 that is captured within slot 132 of the receiver 120. Section 130 includes at least one tab 144 that fit within a corresponding opening 146 in plate 134. Plate 134 and flange 136 provide a clamping force against selected portions of the opposing major surfaces of section 130 which, in combination with tab 144 extending into opening 146, interlocks bracket 118 with receiver 120 and secures window 112 to the window regulator.

Figure 5:
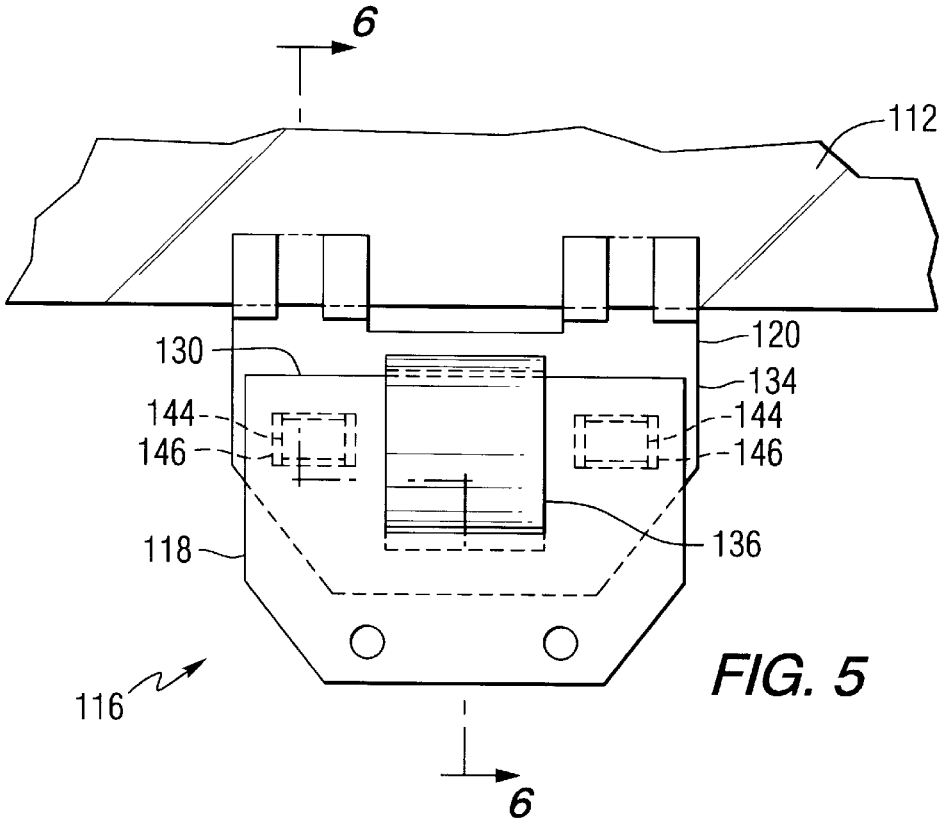
FIG. 5 is a plan view similar to FIG. 2 illustrating an alternate embodiment of the mount assembly of the present invention, with portions removed for clarity.
Figure 6:
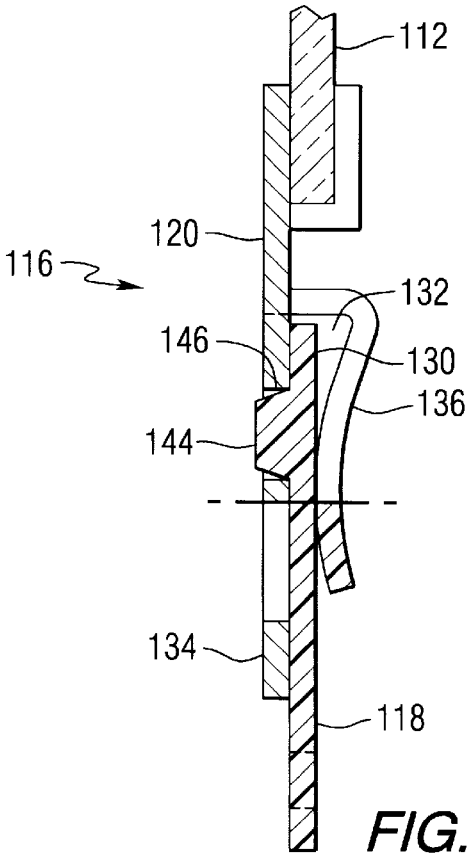
FIG. 6 is a view taken along line 6—6 of FIG. 5, with portions removed for clarity.
Figure 7:
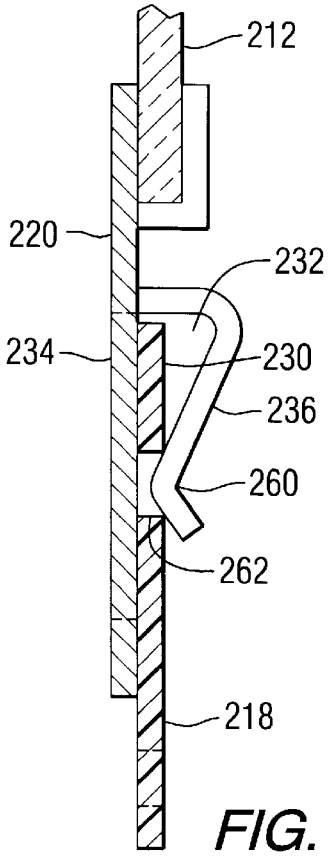
FIG. 7 is a cross-sectional view similar to FIG. 6 illustrating an alternate embodiment of the mount assembly of the present invention, with portions removed for clarity.

As an alternative to extending tab(s) 144 through hole(s) 146 of receiver 120 as shown in FIGS. 5 and 6, referring to FIG. 7, a receiver 220 similar to receiver 120 is secured to window 212 in a manner as discussed above. Receiver 220 includes a plate 234 and flange 236 which form a slot 232. Bracket 218, which is secured to a window regulator (not shown in FIG. 7) includes a section 230 that is received within slot 232 and is held in place, in part, by the clamping force applied by plate 234 and flange 236 to selected portions of the opposing major surfaces of section 230. Flange 236 includes a portion 260 that at least partially fits within a hole 262 in section 230 and serves to interlock bracket 218 and receiver 220. If desired, hole 262 can be replaced with a depression (not shown) in the surface 264 of section 230 of bracket 218 such that portion 260 of flange 236 is received within the depression. In such a configuration, although not required, it is preferred that the shape of the depression on surface 264 of section 230 and portion 260 of flange 236 be generally matched.

In one particular embodiment of the invention, bracket 18 was made from VALOX® 420 plastic, which is a glass filled high-density polyurethane available from G.E. Plastics, Pittsfield, Mass. Bracket 18 was secured to window 12 by Betaseal™ urethane available from Essex Specialty Products, Inc., Auburn Hills, Mich. Section 30 of bracket 18 was approximately 5 mm thick. Receiver 20 was formed from 0.047 inch (1.194 mm) thick 1050 spring steel and secured to regulator 14 by rivets extending through holes 48. The steel was zinc coated to protect against rusting. With section 30 removed from slot 32 of receiver 20, portion 38 of flange 36 was positioned nearly in contact with plate 34. This close spacing provided the required clamping action by receiver 20 against section 30 of bracket 18. Flange 36 further included a lip 52 along portion 38 as shown in FIG. 4 to guide section 30 of bracket 18 into slot 32. Tabs 44 were 20 mm high by 20 mm wide with beveled sides and openings 46 were 20 mm high by 30 mm wide to provide for limited movement of bracket 18 relative to receiver 20 secured to regulator 14 and allow window 12 to align itself in the window frame (not shown) of the vehicle. It should be appreciated that either or both the bracket 18 and receiver 20 of the mount assembly 16 as disclosed herein can be constructed from metal or a plastic material or combinations of materials.

It should be appreciated that although sections 30, 130 and 230 of brackets 18, 118 and 218 disclosed in FIGS. 4, 6 and 7, respectively, are generally aligned and coplanar with windows 12, 112 and 212, this feature is not required in the present invention. More specifically, sections 18, 118 and 218 can be offset relative windows 12, 112 and 212 or may be set at an angle relative to the window, provided that slots 32, 132 and 232 in receivers 20, 120 and 220 are similarly configured to capture sections 30, 130 and 230, respectively.

It should be apparent to those skilled in the art that other mount assemblies may be configured in accordance with the teachings of the present invention. More specifically, such mounting assemblies would include at least a first member securable to at least a portion of one of the major surfaces of a window, and a second member securable to a regulator, wherein the members can be interlocked by extending a portion of one of the elements within a receiving portion of the other element in a manner as taught herein to effect a connection between the window a regulator.

The invention described and illustrated herein represents the description of illustrative preferred embodiments thereof. It is understood that various changes may be made without departing from the gist of the invention defined in the following claims.

I claim:

1. A mount assembly for a vehicle window comprising:

a bracket having a first part of an interlocking assembly and having a first major surface and an opposite major surface defined as a second major surface;

a receiver having a first leg member and a second leg member in facing relationship to the first leg member, having a second part of the interlocking assembly and having one of the leg members biased toward the other leg member to provide a biasing force; and a window holder secured to said bracket or said receiver wherein with said bracket between the first and second leg members of said receiver, the first part of the interlocking assembly interacts with the second part of the interlocking assembly to interlock said receiver and wherein said window holder is spaced from and out of contact with the biasing force provided by the first and second leg members of said receiver to said bracket.

2. The assembly as in claim 1 wherein the first part of the interlocking assembly is at least one opening and the second part of the interlocking assembly is at least one tab, the at least one opening extends at least partially through the first leg member, and the first major surface of said bracket includes the at least one tab and when said bracket is positioned between the leg members of said receiver, the at least one tab extends at least partially into the at least one opening to interlock said bracket and receiver.

3. The assembly as in claim 1 wherein the first part of the interlocking assembly is at least one tab and the second part of the interlocking assembly is at least one opening, said bracket has the at least one opening extending at least partially through one of the major surfaces of said bracket and at least one of the leg members of said receiver has the at least one tab and when said bracket is positioned between the leg members of said receiver, at least a part of the at least one tab extends at least partially into the at least one opening to interlock said bracket and receiver.

4. The assembly as in claim 1 wherein the first part of the interlocking assembly is at least one depression and the second part of the interlocking assembly is a portion of the first leg member of said receiver, said bracket has the at least one depression extending along a portion of the first major surface and positioned such that when said bracket is positioned between the leg members of said receiver, a part of the portion of the first leg member extends at least partially into the at least one depression to interlock said bracket and receiver.

5. The assembly as in claim 4 wherein the portion of the first leg member of said receiver having the second part of the interlocking assembly is configured to generally correspond to at least a portion of the at least one depression.

6. The assembly as in claim 1 wherein said bracket includes said window holder with said window holder securable to a portion of a major surface of a window.

7. The assembly as in claim 1 wherein said receiver includes said window holder with said window holder securable to a portion of a major surface of a window.

8. The assembly as in claim 1 wherein said window holder is secured to said bracket and said receiver is securable to a regulator.

9. The assembly as in claim 1 wherein said window holder is secured to said receiver and said bracket is securable to a regulator.

10. The assembly as in claim 1 wherein said receiver is made from spring steel.

11. A window assembly comprising:

a window;

a bracket having at least one leg member with a portion of the at least one leg member secured to a portion of a major surface of said window and a section extending from the at least one leg member away from and out of contact with the window, the section having first and second opposing major surfaces;

a regulator;

a receiver secured to said regulator and having first and second spaced apart leg members forming a slot, wherein the section of said bracket is positioned within the slot of said receiver such that at least a portion of the first leg member of said receiver contacts the first major surface of the section of said bracket and a portion of the second leg member of said receiver contacts the second major surface of the section of said bracket to provide a clamping force against the section of said bracket, said window spaced from the leg members of the receiver and out of the slot such that no clamping force is applied by the leg members of the receiver against the window and the portion of the at least one leg member of the bracket secured to the portion of the major surface of said window; and an interlocking assembly, the section of said bracket having a first part of said interlocking assembly and at least one of the leg members of said receiver having a second part of the interlocking assembly to interlock said receiver and the section of said bracket to interconnect said bracket having said window secured thereto.

12. The window assembly as in claim 11 wherein the first part of said interlocking assembly is at least one opening and the second part of said interlocking assembly is at least one tab, at least the first leg member of said receiver includes the at least one opening extending at least partially through the first leg member of said receiver, and the first major surface of the section of said bracket includes the at least one tab positioned such that when the section of said bracket is positioned within the slot of said receiver, the at least one tab extends at least partially into the at least one opening to interlock said bracket and receiver.

13. The window assembly as in claim 11 wherein the first part of said interlocking assembly includes a portion of the first leg member of said receiver and the second part of said interlocking assembly includes at least one opening, the section of said bracket includes the at least one opening extending at least partially through said section and positioned such that when the section of said bracket is positioned within the slot of said receiver, at least a part of the portion of the first leg member of said receiver extends at least partially into the at least one opening when the section is positioned in the slot to interlock said bracket and receiver.

14. The window assembly as in claim 11 wherein the first part of said interlocking assembly includes a portion of the first leg member of said receiver and the second part of said interlocking assembly is a depression, the section of said bracket includes the at least one depression extending along a portion of the first major surface and positioned such that when the section of said bracket is positioned within the slot of said receiver, a part of the portion of the first leg member of said receiver extends at least partially into the depression to interlock said bracket and receiver.

15. The window assembly as in claim 11 wherein the window is an automotive window.

16. A window assembly comprising:

a window;

a regulator;

a bracket secured to said regulator and having a section with first and second opposing major surfaces;

a receiver having a portion secured to a portion of a major surface of said window, said receiver having first and second spaced apart leg members forming a slot, wherein the section of said bracket is positioned within the slot of said receiver such that at least a portion of the first leg member of said receiver contacts the first major surface of the section of said bracket and a portion of the second leg member of said receiver contacts the second major surface of the section of said bracket to provide a clamping force against the section of said bracket wherein the window and the portion of said receiver secured to said window is spaced from and out of the slot such that no clamping force is applied by said leg members to the window and to the portion of the receiver secured to the portion of the major surface of the window; and an interlocking assembly having a first part provided on said receiver and a second part provided on said bracket to interlock the spaced apart leg members of said receiver and said bracket and interconnect said receiver having said window secured thereto and said regulator.

17. The window assembly as in claim 16 wherein the first part of said interlocking assembly is at least one opening and the second part of said interlocking assembly is at least one tab, at least the first leg member of said receiver includes the at least one opening extending at least partially through the first leg member of said receiver, and the first major surface of the section of said bracket includes the at least one tab positioned such that when the section of said bracket is positioned within the slot of said receiver, the at least one tab extends at least partially into the at least one opening to interlock said bracket and receiver.

18. The window assembly as in claim 16 wherein the first part of said interlocking assembly includes a portion of the first leg member of said receiver and the second part of said interlocking assembly includes at least one opening, the section of said bracket includes the at least one opening extending at least partially through the section and positioned such that when the section of said bracket is positioned within the slot of said receiver, at least a part of the portion of the first leg member of said receiver extends at least partially into the at least one opening to interlock said bracket and receiver.

19. The window assembly as in claim 16 wherein the first part of said interlocking assembly includes a portion of the first leg member of said receiver and the second part of said interlocking assembly is a depression, the section of said bracket includes the at least one depression extending along a portion of the first major surface and positioned such that when the section of said bracket is positioned within the slot of said receiver, a part of the portion of the first leg member of said receiver extends at least partially into the depression to interlock said bracket and receiver.

20. The window assembly as in claim 16 wherein the window is an automotive window.

* * * * *